US008096207B2

(12) United States Patent
Kazanchy

(10) Patent No.: US 8,096,207 B2
(45) Date of Patent: Jan. 17, 2012

(54) VEHICLE HAND CONTROL APPARATUS

(75) Inventor: John Livingston Kazanchy, Penrose, CO (US)

(73) Assignee: Keith Herbert Howell, New Brunswick (CA)

( * ) Notice: Subject to any disclaimer, the term of this patent is extended or adjusted under 35 U.S.C. 154(b) by 260 days.

(21) Appl. No.: 12/611,240

(22) Filed: Nov. 3, 2009

(65) Prior Publication Data

US 2010/0122599 A1 May 20, 2010

Related U.S. Application Data

(60) Provisional application No. 61/199,224, filed on Nov. 14, 2008.

(51) Int. Cl.
*G05G 11/00* (2006.01)
*G05G 13/00* (2006.01)

(52) U.S. Cl. ..... 74/481; 74/480 R

(58) Field of Classification Search ..... 74/480 R, 74/481, 482, 483 R
See application file for complete search history.

(56) References Cited

U.S. PATENT DOCUMENTS

| | | | | |
|---|---|---|---|---|
| 2,777,335 | A | 10/1954 | Engberg et al. | |
| 3,065,647 | A | 11/1962 | Whitmore | |
| 4,143,734 | A | 3/1979 | Bhattacharya | |
| 4,158,968 | A | 6/1979 | Wilson et al. | |
| 4,228,865 | A | 10/1980 | Appley | |
| 4,424,723 | A | 1/1984 | Gockel | |
| 4,436,191 | A | 3/1984 | Perry | |
| 4,627,522 | A | 12/1986 | Ulrich et al. | |
| 4,788,879 | A | 12/1988 | Ulrich | |
| 4,946,013 | A | 8/1990 | Conlyn, Jr. et al. | |
| 4,993,509 | A | 2/1991 | Howell | |
| 4,998,983 | A | 3/1991 | Ruprecht et al. | |
| 5,025,905 | A | 6/1991 | Lenz | |
| 5,029,679 | A * | 7/1991 | Kim et al. | 477/209 |
| 5,103,946 | A | 4/1992 | Masters et al. | |
| 5,119,688 | A | 6/1992 | Snyder, Jr. | |
| 5,121,651 | A | 6/1992 | Bristow | |
| 5,129,492 | A | 7/1992 | Lenz et al. | |
| 5,542,312 | A | 8/1996 | Peters | |
| 5,709,131 | A * | 1/1998 | Gummery | 74/481 |
| 5,996,752 | A | 12/1999 | Froehlich | |
| 6,435,055 | B1 * | 8/2002 | Sato | 74/481 |
| 6,571,656 | B1 | 6/2003 | Wells | |
| 6,749,535 | B2 | 6/2004 | Spinnato | |
| 2007/0298934 | A1 | 12/2007 | Feng | |

* cited by examiner

*Primary Examiner* — Justin Krause
(74) *Attorney, Agent, or Firm* — Charles J. Prescott

(57) ABSTRACT

A vehicle hand control apparatus for controlling the throttle and brake pedals of a motor vehicle. A support shaft pivotally supports a transverse control arm tube which holds a control shaft for rotation coaxially within the control arm tube. A handle extends from one end of the control arm tube for actuating the brake pedal and also for separate limited pivotal movement about a handle pivot axis orthogonal to the rotational axis of the control arm tube for actuating the accelerator pedal. Pivotal movement of the handle about the handle pivot axis causes separate interacting transfer rods dependently extending from the handle and the control shaft, respectively, to effect rotation of the control shaft and accelerator pedal movement.

9 Claims, 6 Drawing Sheets

VEHICLE HAND CONTROL APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to vehicle control devices, and more particularly to hand operated systems, particularly useful for the physically challenged, for controlling the brake and accelerator pedals of a motorized vehicle.

2. Description of Related Art

For those physically challenged individuals who wish to operate a motorized vehicle, a number of prior art systems have been provided which facilitate operation of such a vehicle through the use of hand operated controls for manipulating the brake and accelerator pedals of the vehicle.

U.S. Pat. No. 4,998,983 to Ruprecht et al. discloses an apparatus having a single lever arm for operating the brake and accelerator of a motor vehicle by hand. Perry teaches a hand-operated system for controlling the throttle and brakes of a vehicle in U.S. Pat. No. 4,436,191.

Mechanisms for manual operation of automotive brake and accelerator pedals that may be used by handicapped drivers are disclosed in U.S. Pat. No. 5,103,946 to Masters et al. U.S. Pat. No. 4,627,522 to Ulrich et al. discloses a mechanism for controlling a vehicle engine and vehicle brakes by hand.

Engberg et al. teach an apparatus for controlling brakes and accelerators by hand in U.S. Pat. No. 2,777,335. A motor vehicle clutch hand control for use by handicapped drivers is taught by Froehlich in U.S. Pat. No. 5,996,752.

U.S. Pat. No. 5,121,651 to Bristow discloses devices for hand operation of throttle and brake pedals. A hand control device for motor vehicles is disclosed in my U.S. Pat. No. 4,993,509.

A drawback to many of the above systems is the amount of drag or friction inherent in the system which makes manual operation of the handle somewhat difficult. Further, each of the prior art devices is dedicated to a particular mode of operation of the handle wherein only one predetermined mode of movement for the accelerator pedal control is established based upon the particular design of each of these systems. The present system provides for extremely low inherent system friction between moving components to effect translation of handle movement into accelerator pedal movement with considerably less manual force applied to the handle. Further, with simple design selection, either of two operational modes may be incorporated into the particular assembly chosen. Movement of the handle either downwardly or toward the operator may be selected as determinative of the mode of operation incorporated into the system for accelerator pedal operation.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a vehicle hand control apparatus for controlling the throttle and brake pedals of a motor vehicle. A support shaft pivotally supports a transverse control arm tube which holds a control shaft for rotation coaxially within the control arm tube. A handle extends from one end of the control arm tube for actuating the brake pedal and also for separate limited pivotal movement about a handle pivot axis orthogonal to the rotational axis of the control arm tube for actuating the accelerator pedal. Pivotal movement of the handle about the handle pivot axis causes separate interacting transfer rods dependently extending from the handle and the control shaft, respectively, to effect rotation of the control shaft and accelerator pedal movement. This unique motion transfer arrangement between interacting transfer rods further provides for accelerator movement at greatly reduced levels of drag and travel of the handle.

It is therefore an object of this invention to provide a vehicle hand control apparatus for controlling the throttle and brake pedals of a motorized vehicle which has inherently lower internal friction characteristics for ease of operation.

It is another object of this invention to provide a vehicle hand control apparatus for motorized vehicles which is easily manufacturable for either of two modes of operation of the handle in controlling accelerator pedal movement with minimal component alterations.

It is still another object of this invention to provide a vehicle hand control apparatus which regulates accelerator pedal movement at greatly reduced levels of frictional drag and increased leverage advantage resulting in substantially reduced travel of the handle.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

List of Components

10. Mode 1 Control Apparatus
12. Control Arm Assembly
14. Handle Assembly
16. Throttle Control Assembly
18. Handle
20. Handle Anchor Block
22. Handle Support Plate
24. Stop
26. Control Arm Tube
28. Control Shaft
30. Handle Transfer Rod
32. Control Shaft Transfer Rod
34. Brake Rod Anchor Plate
36. Brake Rod
38. Support Shaft
40. Support Shaft Anchor Plate
42. Throttle Arm Lever
44. Throttle Rod
46. Transfer Rods Contact Point
48. Handle Pivot Pin
50. Mode 2 Control Apparatus
52. Control Arm Assembly
54. Handle Assembly
56. Throttle Control Assembly
58. Handle
60. Handle Anchor Block
62. Handle Support Arm
64. Stop
68. Control Shaft
70. Handle Transfer Rod
72. Control Shaft Transfer Rod
74. Brake Rod Anchor Plate
76. Transfer Rods Contact Point
78. Handle Pivot Pin
A Brake Movement
B Throttle Movement
C Handle Rotation
D Throttle Shaft Rotation
E Handle Pivot Axis (Mode 1)
E' Handle Pivot Axis (Mode 2)
F Brake Rod Pivot Axis
G Brake Rod Movement
H Handle Transfer Rod Pivotal Movement
J Control Arm Pivotal Movement
K Support Shaft Pivot Axis
L Throttle Arm Rotation
M Control Shaft Rotational Axis
N Throttle Rod Pivot Axis
P Throttle Rod Separation

Mode 1

Figure 1:
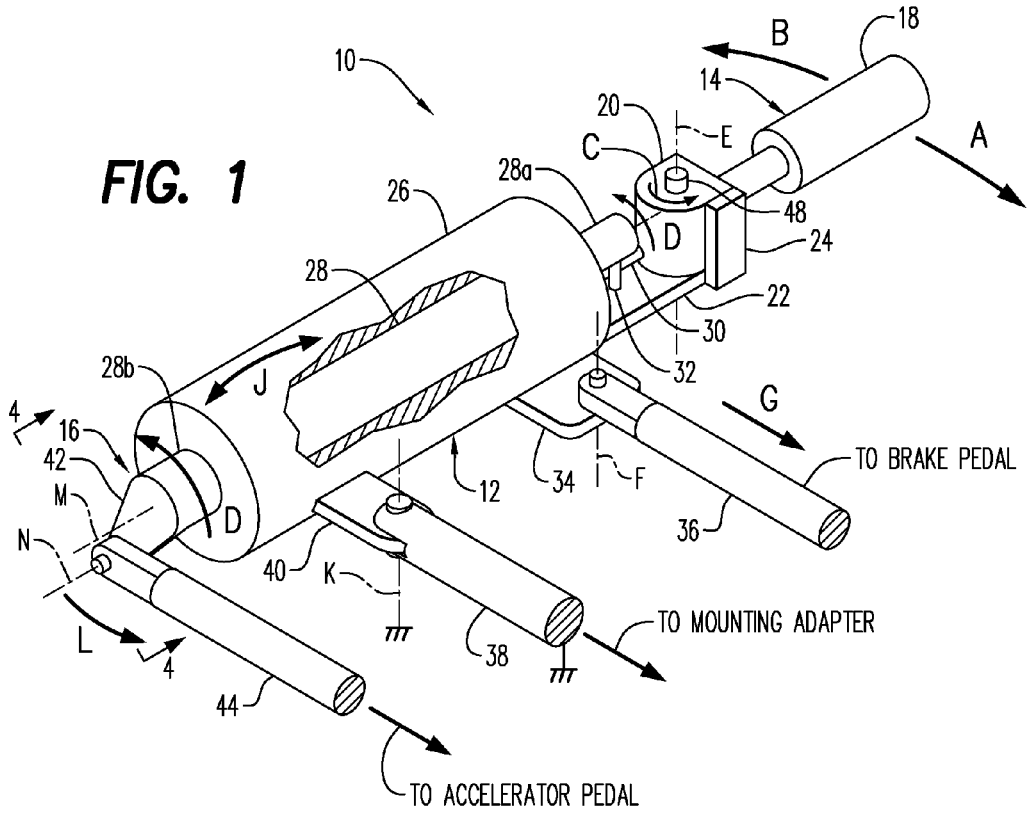
FIG. 1 is a perspective broken view of one embodiment of the disclosure.
Figure 2:
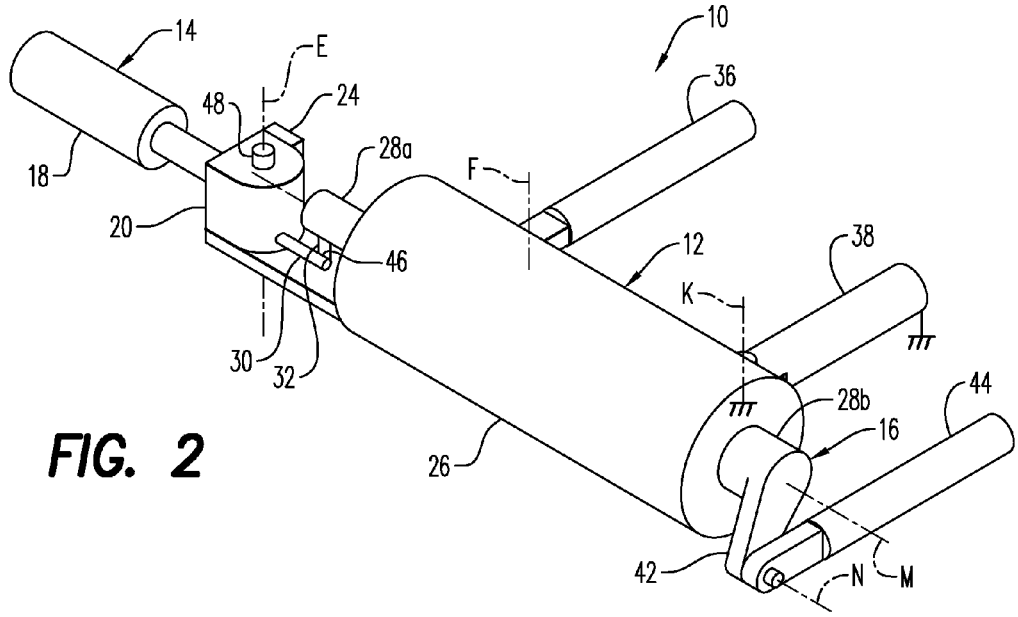
FIG. 2 is another perspective view of FIG. 1.

Referring now to the drawings, and firstly to FIGS. 1 to 5, one embodiment is there shown generally at numeral 10 and represents a first mode of operation of this disclosure. As best seen in FIG. 1, this Mode 1 control apparatus 10 selectively activates either the brake pedal or the accelerator pedal, the brake pedal being activated by pushing the handle 18 in the direction of arrow A or away from the operator toward the dash panel of a motor vehicle. To activate the accelerator pedal, handle 18 is pulled toward the operator of the vehicle in the direction of arrow B or oppositely or at 180° with respect to brake pedal activation.

Generally, the Mode 1 control apparatus 10 includes a control arm assembly 12, a handle assembly 14, and a throttle control assembly 16. The control arm assembly 12 includes an elongated control arm tube 26 which supports an elongated control shaft 28 held coaxially within the control arm 26 for rotational movement in the direction of arrow D. The control arm assembly 12 is supported in proximity to the steering wheel and steering column of the motor vehicle by an elongated support shaft 38 which is pivotally connected to the control arm tube 26 about a pivot pin having support shaft pivot axis K through support shaft anchor plate 40 rigidly attached to, and laterally extending from, the control arm tube 26 as shown. The support shaft 38 is shown supportedly grounded to the motor vehicle by appropriate interconnection to either the steering column structure or the under dashboard structure as available in each particular motor vehicle by well-known means. By this arrangement, the control arm assembly 12 is pivotable in a generally horizontal plane in the direction of arrow J about the pivot axis K in limited fashion by the application of manual hand pressure against the handle assembly 14 in the direction of arrow A as previously described.

Brake Pedal Actuation

The handle assembly 14 is supported on a handle support plate 22 rigidly connected to, and longitudinally extending from, the control arm tube 26 and includes a handle anchor block 20 which is mounted for rotation on handle pivot shaft 48 about a generally upright handle pivot axis E. The handle pivot shaft 48 being connected in generally orthogonal orientation to the handle support plate 22. A stop 24 is also connected to the handle support plate 22 to prevent over-rotation of the elongated handle 18 about handle pivot axis E in the direction of arrow A while allowing for pivotal movement of the handle 18 about handle pivot axis E in the direction of arrow B. Thus, when handle 18 is manually pushed in the direction of arrow A, a flat surface of the handle anchor block 20 comes in contact directly against stop 24 so that the combination of the handle assembly 14 and the control arm assembly 12 pivot as a longitudinal unit in the direction of arrow A about the upright support shaft pivot axis K.

When the handle 18 is manually pushed in the direction of arrow A, a brake rod 36, pivotally connected about an upright brake rod pivot axis F, defined by a pivot pin formed as a part of a brake rod anchor plate 34 rigidly connected to one end of the control arm tube 26, causes the brake rod 36 to move in the direction of arrow G. The opposite end of the brake rod 36 is connected to the brake pedal of the motor vehicle (seen in FIG. 9) to effect braking of the motor vehicle.

Figure 9:
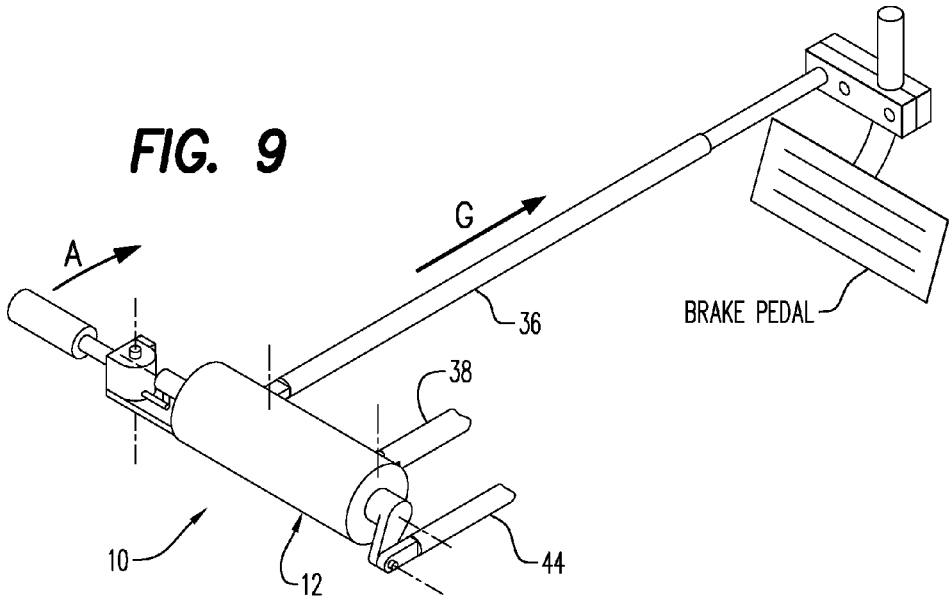
FIG. 9 is another perspective view of the Mode 1 embodiment of FIG. 1.

Note that the brake rod 36 being non-extensibly connected to the brake pedal as best seen in FIG. 9 serves to restrain any substantial amount of pivotal movement of the control arm assembly 12 about the support shaft pivotal axis K as this brake rod 36 is substantially rigid and non-extensible or non-compressible.

Accelerator Pedal Actuation

Figure 3:
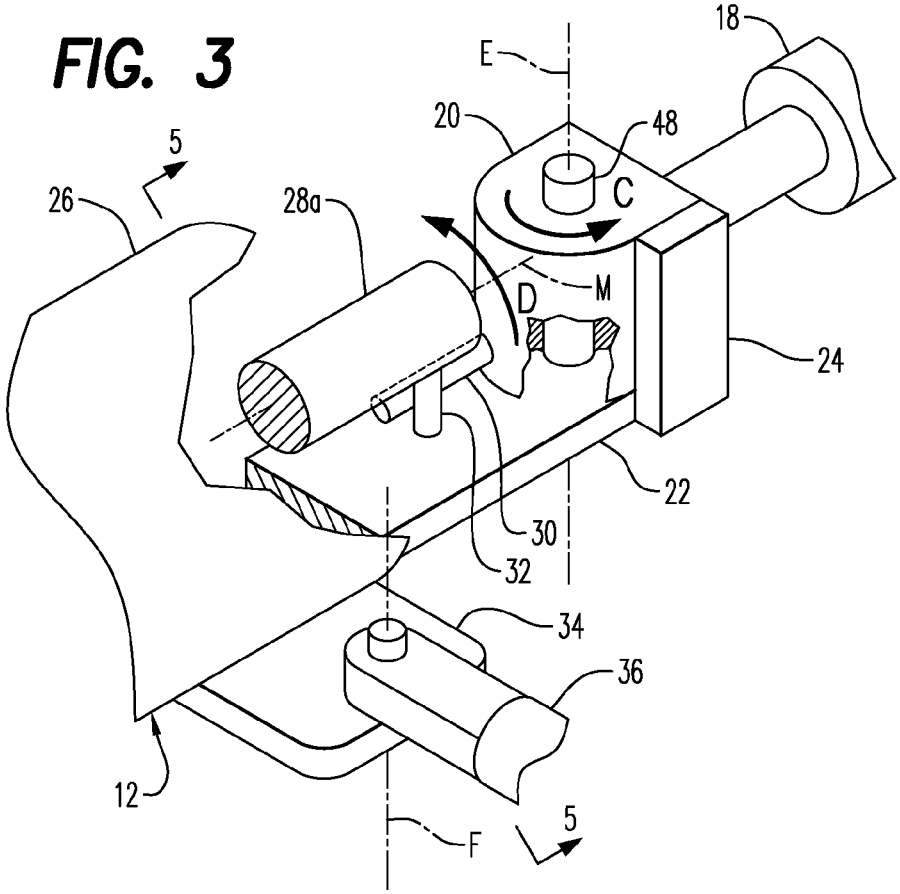
FIG. 3 is an enlarged view of a portion of FIG. 1.
Figure 4:
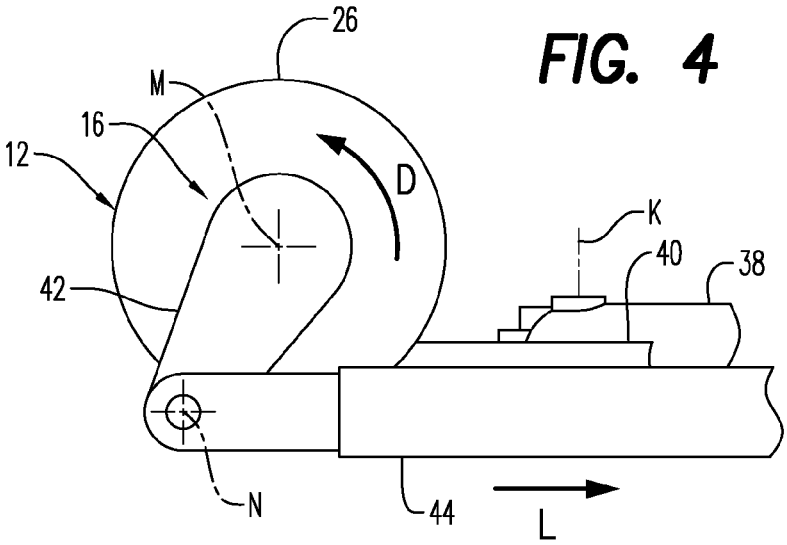
FIG. 4 is an end view in the direction of arrows 4-4 in FIG. 1.
Figure 5:
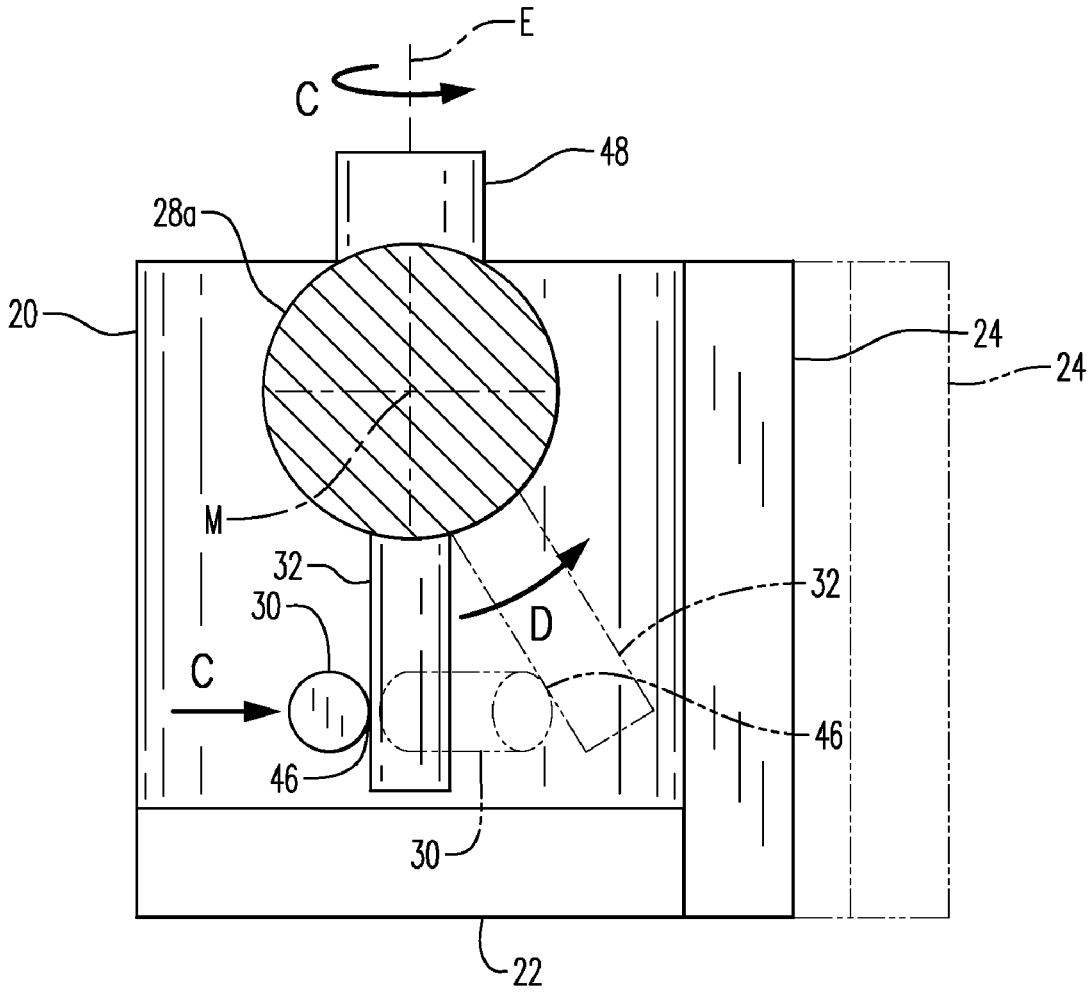
FIG. 5 is a section view in the direction of arrows 5-5 in FIG. 3.

As best seen in FIG. 3, a slender control shaft transfer rod 32 is connected to and extends transversely downwardly from, one end 28*a* of the control shaft 28 which is mounted for rotation only about a control shaft rotational axis M concentrical with a mating longitudinal bore formed through the control arm tube 26. A slender handle transfer rod 30 is connected to, and extends longitudinally from, the handle anchor block 2° and is oriented and sized in length to make contact at a contact point 46 between the two transfer rods 30 and 32. By this arrangement, when the handle 18 is manually pulled in the direction of arrow B about the handle pivot axis E, rotation of the handle anchor block 20 occurs in the direction of arrow C causing the handle transfer rod 30 to move from the position shown in solid lines in FIG. 5 to the position shown in phantom. This causes the control shaft transfer rod 32 to rotate, along with control shaft 28 in the direction of arrow B into the position shown in phantom, the contact point 46 also moving into the position shown in phantom in FIG. 5.

The opposite end 28*b* of the control shaft 28 includes a throttle arm lever 42 having a connecting pin at a distal end thereof oriented about throttle rod pivot axis N laterally displaced from and parallel to the control shaft rotational axis M. One end an elongated throttle rod 44 is pivotally connected to the throttle arm lever 42 about the throttle rod pivot axis N, the other end of the throttle rod 44 extending to and being connected to the pedal accelerator of the motor vehicle as shown in FIG. 10.

When the handle 18 is manually pulled in the direction of arrow B causing the handle anchor block 20 to be rotated in the direction of arrow C about the handle pivot shaft 48, the transfer rods 30 and 32 interact as previously described causing the control shaft 28 to rotate in the direction of arrow D. As result, the throttle lever arm 42 rotates in the direction of arrow L causing the throttle rod 44 to activate the pedal accelerator in proportion to the amount of pivotal movement of the handle 18 in the direction of arrow B.

Figure 10:
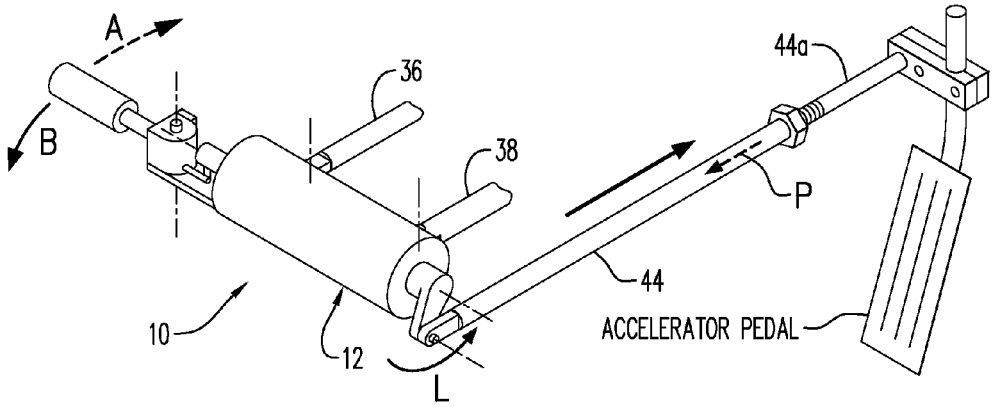
FIG. 10 is another perspective view of the Mode 1 embodiment of FIG. 1.

Note that, as shown in FIG. 10, to avoid pulling on the accelerator pedal when the handle 18 is pushed in the direction of arrow A to actuate the brake pedal, the throttle rod 44 will separate from contact against a hex nut threaded onto the lower portion 44*a* of the throttle rod in the direction of arrow P.

Mode 2

Figure 6:
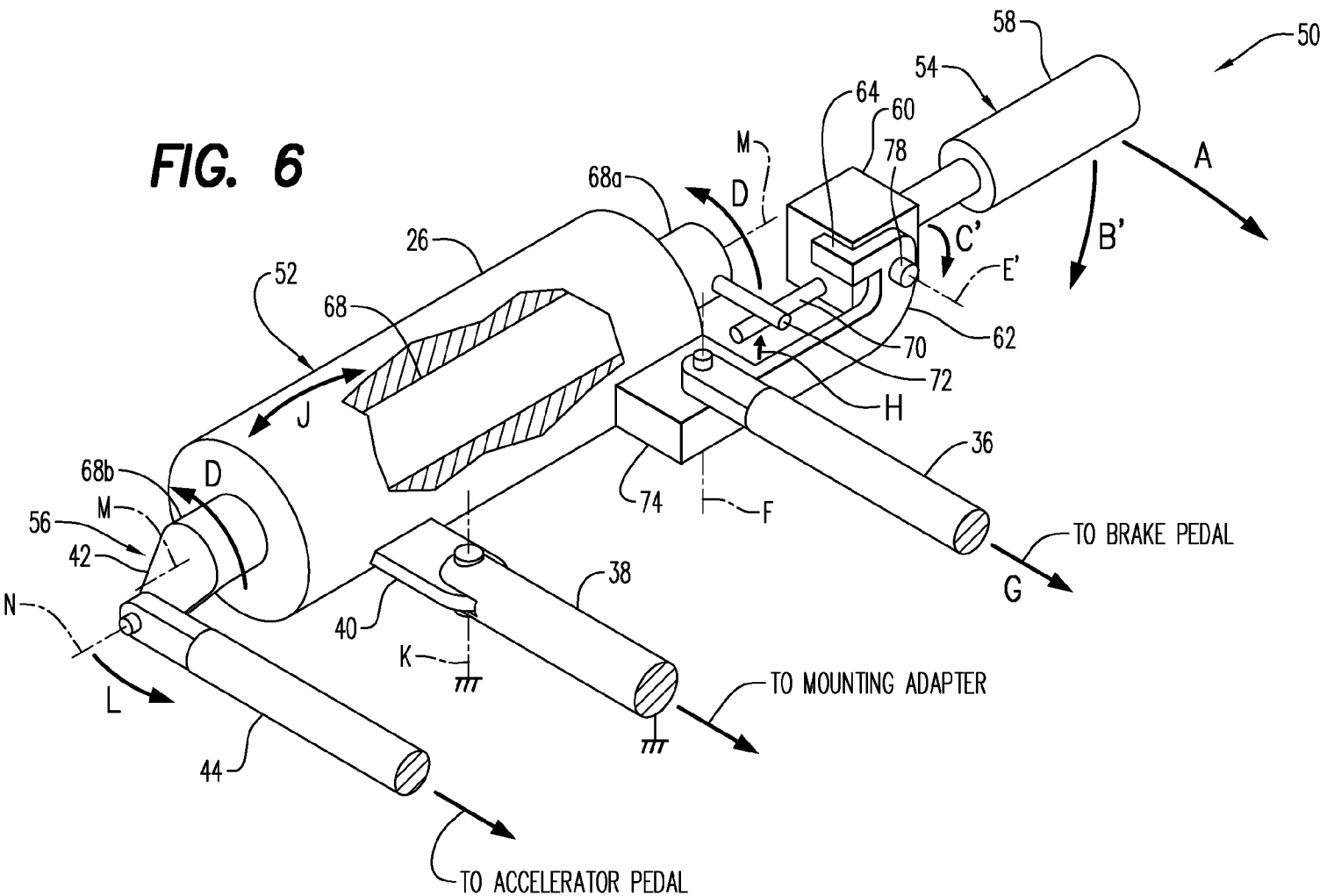
FIG. 6 is broken perspective view of another embodiment.
Figure 7:
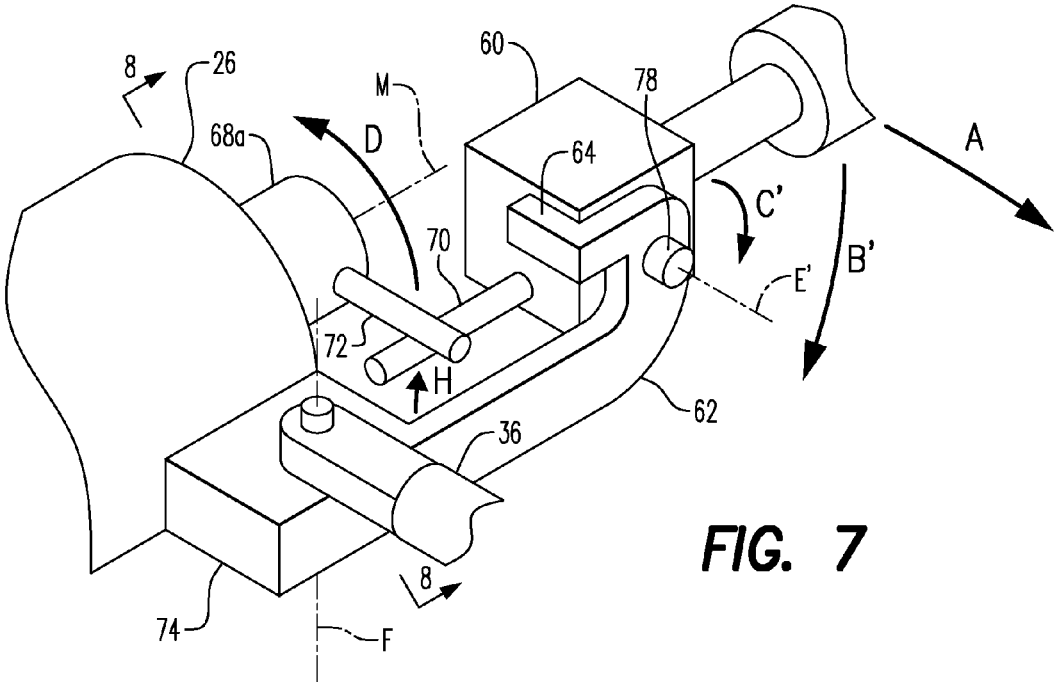
FIG. 7 is an enlarged view of a portion of FIG. 6.
Figure 8:
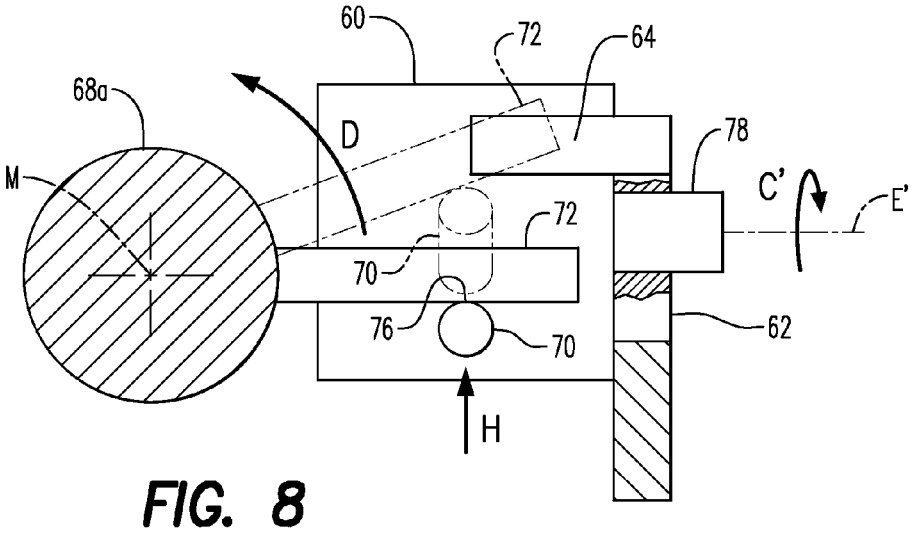
FIG. 8 is a section view in the direction of arrows 8-8 in FIG. 7.

Referring now to FIGS. 6 to 8, an alternate embodiment of the apparatus is there shown generally at numeral 50 and represents the Mode 2 embodiment. In this embodiment 50, the handle 58 is movable away from the operator in the direction of arrow A to apply brake pedal movement in the direction of arrow G along the brake rod 36, while application of throttle control to the motor vehicle is effected by downward movement of handle 58 in the arcuate direction of B', a movement generally orthogonally oriented to the movement A for brake pedal actuation.

The handle assembly 54 is pivotally mounted about a handle pivot pin 78 and the handle pivot axis E' in the direction of arrow C'. The handle pivot pin 78 is dependently rigidly connected to a handle support arm 62 which in turn is rigidly connected to one end of the control arm tube 26 at a break rod anchor plate 74 formed as a part of the handle support arm 62. Alternately, handle pivot pin 78 may be rigidly connected to handle anchor block 60, either mounting option allowing for free pivotal movement of handle 58 in the direction of arrow B' about handle pivot axis E'.

A limiting stop 64 acts against a flat inwardly facing surface of the handle anchor block 60 which, in turn, rigidly supports the handle 68, bears against the stop 64 to prevent upward pivotal movement of the handle 58 about the handle pivot axis E' oppositely from arrow B' from the position shown in FIG. 6. Thus, the handle 58 will only move downwardly in the direction of arrow B' about the handle pivot axis E' to effect accelerator pedal movement as described herebelow.

To accomplish this Mode 2 operation wherein the handle 58, when pushed in the direction of arrow A will effect pedal actuation, while orthogonal pivotal movement in the direction of arrow B' of the handle 58 will effect accelerator pedal actuation, a slender elongated handle transfer rod 70 is rigidly connected into the handle anchor block 60 and extends longitudinally toward one end 68*a* of the control shaft 68. A control shaft transfer rod 72 is connected to, extends transversely from the end of the 68*a* of the control shaft 68, the transfer rods 70 and 72 sized and orthogonally oriented to contact one another at 76 when in the neutral or at rest position shown in solid lines in FIGS. 6 to 8. Downward pivotal movement of the handle 58 in the direction of arrow B' about the handle pivot axis E' causes the handle transfer rod 70 to pivot upwardly in the direction of arrow H, moving into the position shown in phantom in FIG. 8. This consequently causes the control shaft transfer rod 72 to move in the direction of arrow D into the position shown in phantom in FIG. 8.

All of the other functions of this apparatus 50 are as previously described with respect to the Mode 1 embodiment 10 shown in FIGS. 1 to 5. Note that the rigid connection of the support shaft 38 (shown grounded) held for pivotal motion only about the support shaft pivot axis K by support shaft anchor plate 40 prevents unwanted rotation of the control arm assembly 52 when the handle 58 is pivoted downwardly in the direction of arrow B'. Thus, by providing this embodiment 50, the movement to effect brake pedal actuation in the direction of arrow A of handle 58 is generally orthogonal to the pivotal movement of the handle 58 in the direction of arrow B' about the handle pivot axis E' which actuates the accelerator pedal and the throttle of the motor vehicle.

In general, this disclosure teaches the transfer of motion from a handle to an accelerator pedal in a unique arrangement of interacting, generally orthogonally oriented slender handle and control shaft transfer rods. The handle transfer rod/control shaft transfer rod sliding point contact greatly reduces friction and also provides a unique progressive accelerator pedal geometry and movement "feel".

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A vehicle hand control apparatus operable to control throttle and brake pedals of a motor vehicle comprising:

an elongated support shaft connectable at a first end thereof to, and extending generally longitudinally of, the vehicle;

a control arm tube dependently connected for pivotal movement only at a midpoint thereof to a second end of said support shaft;

an elongated control shaft coaxially mounted for rotation only within, and extending beyond each end of, said control arm tube about a rotational axis thereof;

an elongated brake rod connectable at a first end thereof to the brake pedal, a second end of said brake rod pivotally or universally connected proximate to a first end of said control arm tube;

a handle pivotally connected for limited pivotal movement about a handle pivot axis proximate to the first end of said control arm tube in spaced relation to a first end of said control shaft, said handle pivot axis being oriented generally orthogonally to said rotational axis;

a throttle arm lever extending laterally from a second end of said control shaft and pivotally or universally connectable to one end of an elongated throttle rod, another end of said throttle rod being connectable to the accelerator pedal whereby rotation of said control shaft causes a corresponding movement of the accelerator pedal;

an elongated handle transfer rod extending generally axially from said handle toward the first end of said control shaft;

an elongated control shaft transfer rod extending generally laterally from the first end of said control shaft;

said handle transfer rod contacting said control shaft transfer rod and rotating said control shaft responsive to pivotal movement of said handle about said handle pivot axis.

2. A vehicle hand control apparatus as set forth in claim 1, wherein:

said handle pivot axis is oriented generally upright.

3. A vehicle hand control apparatus as set forth in claim 1, wherein:

said handle pivot axis is oriented generally horizontally.

4. A vehicle hand control apparatus operable to selectively control throttle and brake pedals of a motor vehicle comprising:

an elongated support shaft connectable at a first end thereof to, and extending generally longitudinally of, the vehicle;

a control arm tube dependently connected at a midpoint therealong for pivotal movement only to a second end of said support shaft about a generally upright support shaft pivot axis;

an elongated control shaft coaxially mounted for rotation only within, and extending beyond each end of, said control arm tube about a control shaft rotational axis thereof;

an elongated brake rod connectable at a first end thereof to the brake pedal, a second end of said brake rod pivotally or universally connected proximate to a first end of said control arm tube;

a handle pivotally connected for limited pivotal movement about a handle pivot axis proximate to the first end of said control arm tube in spaced relation to a first end of said control shaft, said second axis being oriented generally orthogonally to said rotational axis;

a throttle arm lever extending laterally from a second end of said control shaft and being pivotally or universally connectable at a distal end thereof to one end of an elongated throttle rod, another end of said throttle rod being connectable to the accelerator pedal whereby rotation of said control shaft causes a corresponding movement of the accelerator pedal;

an elongated handle transfer rod extending generally axially from said handle toward the first end of said control shaft;

an elongated control shaft transfer rod extending generally laterally from the first end of said control shaft;

said handle transfer rod contacting said control shaft transfer rod and rotating said control shaft responsive to pivotal movement of said handle about said handle pivot axis.

5. A vehicle hand control apparatus as set forth in claim 4, wherein:

said handle pivot axis is oriented generally upright.

6. A vehicle hand control apparatus as set forth in claim 4, wherein:

said handle pivot axis is oriented generally horizontally.

7. A vehicle hand control apparatus operable to control throttle and brake pedals of a motor vehicle comprising:

an elongated support shaft connectable to, and extending generally longitudinally of, the vehicle;

a control arm tube dependently pivotally connected centrally along a length thereof to, and transversely extending with respect to, said support shaft;

an elongated control shaft coaxially mounted for rotation and coextensive within said control arm tube;

an elongated brake rod pivotally connectable and extending between the brake pedal and adjacent to one end of said control arm tube;

a handle pivotally connected to the one end of said control arm tube about a handle pivot axis oriented generally orthogonally to said control arm tube;

a throttle arm lever extending laterally from another end of said control shaft, a distal end of said throttle arm lever being pivotally connectable to one end of an elongated throttle rod, another end of said throttle rod being connectable to the accelerator pedal wherein rotation of said control shaft causes a corresponding movement of the accelerator pedal;

an elongated handle transfer rod extending generally axially from said handle toward the first end of said control shaft;

an elongated control shaft transfer rod extending generally laterally from the first end of said control shaft;

said handle transfer rod contacting said control shaft transfer rod and rotating said control shaft responsive to pivotal movement of said handle about said second axis.

8. A vehicle hand control apparatus as set forth in claim 7, wherein:

said handle pivot axis is oriented generally upright.

9. A vehicle hand control apparatus as set forth in claim 7, wherein:

said handle pivot axis is oriented generally horizontally.

* * * * *